US008505977B2

(12) United States Patent
Duparc

(10) Patent No.: US 8,505,977 B2
(45) Date of Patent: Aug. 13, 2013

(54) BOOK HAVING SLEEVE PROTECTED PAGES AND BINDING METHOD THEREOF

(75) Inventor: Yoel Duparc, Jerusalem (IL)

(73) Assignee: Magen Hasefer Ltd., Jerusalem (IL)

( * ) Notice: Subject to any disclaimer, the term of this patent is extended or adjusted under 35 U.S.C. 154(b) by 16 days.

(21) Appl. No.: 13/215,295

(22) Filed: Aug. 23, 2011

(65) Prior Publication Data

US 2013/0049344 A1 Feb. 28, 2013

(51) Int. Cl.

| | |
|---|---|
| ***B42D 1/00*** | (2006.01) |
| ***B42D 5/00*** | (2006.01) |
| ***B42D 3/04*** | (2006.01) |
| ***B42D 1/08*** | (2006.01) |
| ***B42D 3/00*** | (2006.01) |
| ***B24D 3/02*** | (2006.01) |
| ***B24D 15/00*** | (2006.01) |
| ***B42F 5/00*** | (2006.01) |

(52) U.S. Cl.
USPC ..... 281/20; 281/3.1; 281/15.1; 281/19.1; 281/21.1; 281/22; 281/29; 281/31; 281/35; 281/38; 283/63.1; 283/64

(58) Field of Classification Search
USPC ..... 281/3.1, 15.1, 19.1, 20, 21.1, 22, 281/29, 31, 35, 38; 283/63.1, 64; 402/79, 402/80 P
See application file for complete search history.

(56) References Cited

U.S. PATENT DOCUMENTS 5,772,349 A * 6/1998 Tubergen ..... 402/79
2007/0252377 A1* 11/2007 El-Sorroge ..... 281/29

* cited by examiner

*Primary Examiner* — Dana Ross
*Assistant Examiner* — Justin V Lewis
(74) *Attorney, Agent, or Firm* — Mark M. Friedman

(57) ABSTRACT

A book of sleeve protected pages bound together to form a sleeve bundle cradled inside a receiving channel formed by a hardcover spine and longitudinal flanges extending from the spine and a method of binding thereof.

20 Claims, 3 Drawing Sheets

BOOK HAVING SLEEVE PROTECTED PAGES AND BINDING METHOD THEREOF

FIELD AND BACKGROUND OF THE INVENTION

The present invention relates to books and, in particular, it is concerned with the books having sleeve protected pages and their binding.

U.S. Pat. Nos. 1,201,700, 2,876,572, 5,002,447 and 6,742,812 all disclose arrangements providing for the insertion and removal of materials into protective covering or sleeves but do not provide permanent protections for book pages. U.S. Publication 2001/0194090 and Japanese publication JP-09-323050 both disclose books having pages protected by way of lamination.

It would be advantageous to have each book page permanently fixed inside transparent, protective sleeve.

SUMMARY OF THE INVENTION

The present invention is a book having sleeve protected pages and a method of binding thereof.

According to the teachings of the present invention there is provided book includes: (a) plurality of pages, each of said plurality of pages being disconnected from each other; and (b) a plurality of protective sleeves, each of said pages being disposed in a respective sleeve of said plurality of sleeves, said plurality of sleeves bound together into a bundle by way of a fastener such that each of said pages is permanently held inside its said respective sleeve within said bundle.

According to a further feature of the present invention, the sleeve is formed of a transparent, polymeric material According to a further feature of the present invention, the fastener includes at least one metallic wire.

According to a further feature of the present invention, the fastener includes a plurality of rivets.

According to a further feature of the present invention, the fastener includes stitching.

According to a further feature of the present invention, the fastener includes glue.

According to a further feature of the present invention, there is also provided a hardback spine having longitudinal spine flanges forming a receiving channel in which said bundle of protective sleeves is cradled.

According to a further feature of the present invention, there is also provided two hardback covers, each of said covers hinged to one of said spine flanges so as to enable said covers to be opened and closed.

There is also provided according to the teachings of the present invention, a book includes: (a) a plurality of pages, each of said pages is permanently enclosed in a separate protective sleeve, said sleeves fastened together to form a bundle of protective sleeves; and (b) a hardback spine having longitudinal flanges forming a receiving channel in which said bundle of protective sleeves is cradled.

According to a further feature of the present invention, there is also provided two hardback covers, each of said covers hinged to one of said spine flanges so as to enable said covers to be opened and closed.

There is also provided according to the teachings of the present invention, a method of binding a book of sleeve protected pages includes: (a) providing a plurality of protective sleeves; (b) enclosing one book page in each of said protective sleeves; and (c) fastening said sleeves into a bundle by way of a fastener, wherein said one book page is permanently disposed in each of said protective sleeves in said bundle.

According to a further feature of the present invention, the step of fastening said sleeves into a bundle by way of a fastener includes stapling.

According to a further feature of the present invention, the step of fastening said sleeves into a bundle by way of a fastener includes gluing.

According to a further feature of the present invention, the step of fastening said sleeves into a bundle by way of a fastener includes riveting.

According to a further feature of the present invention, the step of fastening said sleeves into a bundle by way of a fastener includes sewing.

According to a further feature of the present invention, the step of fastening said sleeves into a bundle by way of a fastener gluing.

According to a further feature of the present invention, there is also provided a step of cradling said bundle of protective sleeves in a receiving channel formed by hardback spine having longitudinal, spine flanges.

According to a further feature of the present invention, there is also provided a step of attaching a hardback cover to each of said spine flanges so as to enable said covers to be opened and closed.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is book having a sleeve protected pages and a method of binding thereof.

The principles and operation of the method according to the present invention may be better understood with reference to the drawings and the accompanying description.

Figure 1:
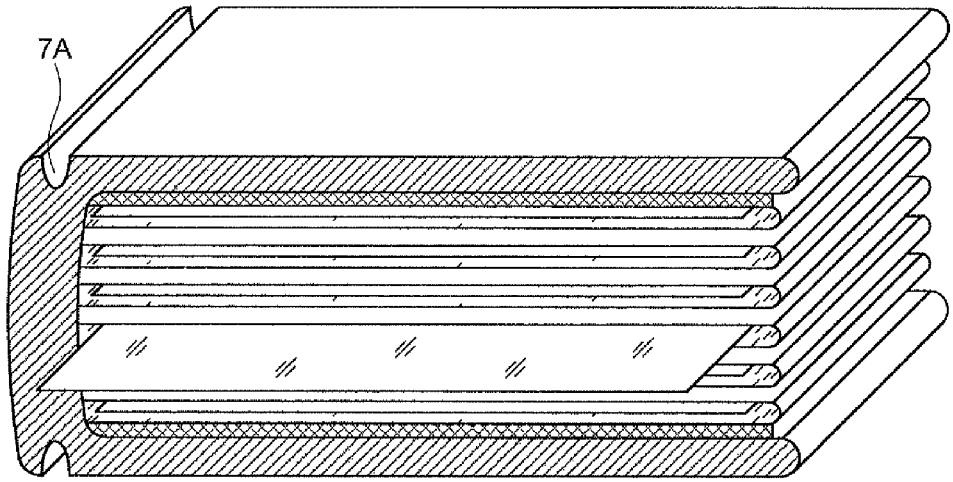
FIG. 1 (PRIOR ART)
FIG. 1 is an isometric view of a prior art book having sleeves configured for insertion and removal of materials.

Turning now to the drawings, FIG. 1 depicts the prior art book having sleeves in which printed materials can be inserted and removed. The sleeves are typically heat sealed together and glued to the spine. The cover opens and closed along hinge 7*a* disposed contiguously along each longitudinal edge of the book spine.

Figure 2:
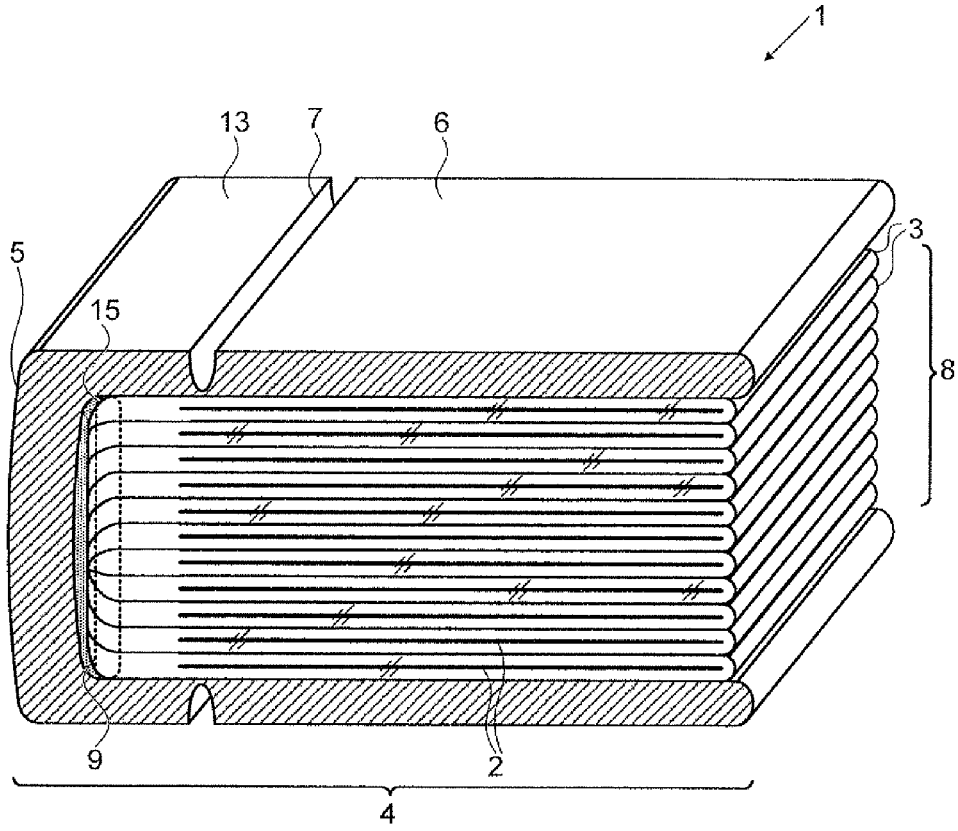
FIG. 2 is an isometric view of book containing sleeve protected pages fastened into a bundle and cradled inside a hardcover.

FIG. 2 depicts a book of the present invention, generally denoted 1, in which each book page 2 is disposed inside its own individual, transparent protective sleeve 3. Sleeves 3 are fastened together into a bundle and disposed inside a hardcover casing, generally designated 4, and glued with glue 15. Hardcover casing 4 includes a spine 5 and longitudinal, spine flanges 13 hinged to hardback covers 6 by way of hinge 7 to enable hardback covers 6 to be opened and closed. In a non-limiting, embodiments, spine flanges 5 and hardback covers 6 are held together by way of cloth, paper or leather attached to the surfaces of spine flanges 13 and hardback cover 6. Alternatively, hardback covers 6 are held to spine flanges 13 by way of compressed cardboard spanning them so as to form hinge 7, all as is known in the art.

Figure 3:
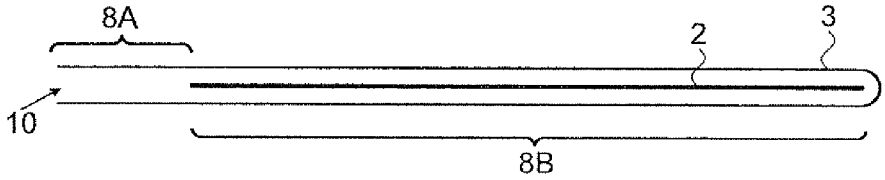
FIG. 3 is a schematic, side cross-sectional view of a single page disposed inside a protective sleeve.

FIG. 3 depicts a single sleeve 3 containing one book page 2. It should be appreciated that in an exemplary, non-limiting embodiment fore edge 8 and the two adjacent edges of sleeve 3 are permanently sealed whereas a back edge has an opening 10 to enable insertion of book pages 2 into sleeves 3. It should be noted that sleeves sealed on each so as to permanently enclose the page 2 inside sleeve 3 is included within the scope of the present invention. It should also be appreciated that two pages displaying material on each outer face is considered one page for the purposes of this document. Sleeve 3 includes a sleeve extension 8*a* extending about 1.5 centimeter beyond sleeve width 8*b* that is substantially equal to the width of page 2 to facilitate binding of sleeve 3 without binding pages 2 disposed inside sleeve 3. Sleeves 3 have a height slightly greater than that of page 2 in an exemplary, non-limiting embodiment. It should be noted that in an exemplary, non-limiting embodiment, sleeves 3 are constructed from nylon, cellophane or any water resistant, polymeric material transparent, semi-transparent or colored. Sleeves 3 are constructed by those methods means known to those skilled in the art.

Figure 4:
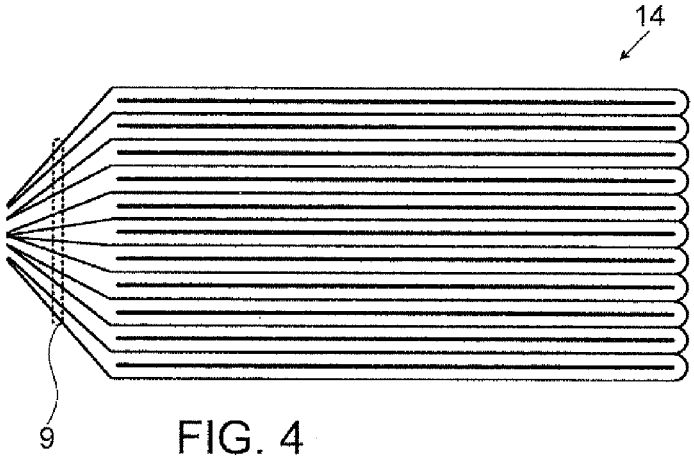
FIG. 4 is a schematic, side cross-sectional view of a sleeve bundle formed by way of a fastener.

FIG. 4 depicts sleeves 3 bound by way of a fastener 9. Fastener 9, in an exemplary, non-limiting embodiment is implemented as a metallic pin; however, it should be appreciated that plastic pins, rivets, clamps, stitching, glue and any other fastening means is included within the scope of the present invention. Fastener 9 is inserted through all sleeves so as to close sleeve opening 10 and to bind sleeves 3 into a sleeve bundle 14 without puncturing or reducing viewing accessibility of page 2. It should be noted that sleeves having a flange disposed along the back edge to facilitate binding are also included within the scope of the present invention.

It should be noted that in the above described configuration, each page 2 is permanently disposed in sleeves 3 in regards to daily usage; however, the present invention advantageously allows occasional replacement of page 2 or a damaged sleeve 3 by unbinding sleeves 3 and then rebinding them after the appropriate replacement has been executed This flexibility provides on one hand permanent protection, while one the other, provides for periodic upgrade or repair.

Figure 5:
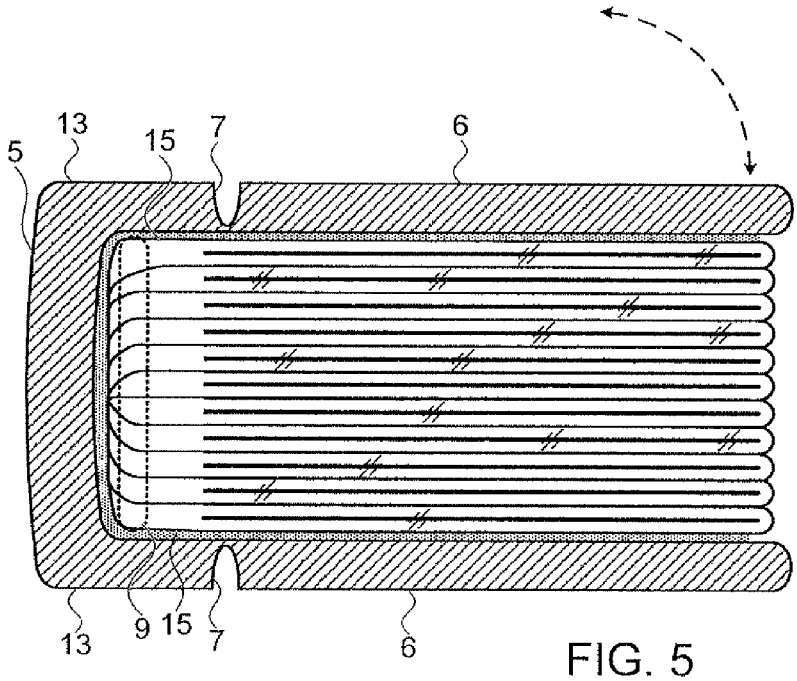
FIG. 5 is a schematic, side cross-sectional view of the sleeve bundle of FIG. 4 cradled inside a receiving channel formed by a hardcover spine and its flanges and glued to a cover.

FIG. 5 depicts the bundled sleeves of FIG. 3 disposed inside spine flanges 13 of hardcover casing 4. As noted above, the hardcover casing 4 includes spine 5, spine flanges 13, hardback covers 6, and hinge 7. In the present invention hinge 7 is shifted towards fore edge 8 so as to form two longitudinal, spine flanges 13 that together with spine 5 serve as a receiving channel cradling sleeve bundle 14. In an exemplary, non-limiting embodiment hinge 7 is shifted about 12 millimeters towards the fore edge 8 and typically has a width of about 7 millimeters, It should be appreciated; however, that any distance of hinge shift towards the fore edge 8 that enables spine flanges 13 to cradle and support sleeve bundle 14 is included within the scope of the present invention. It should also be noted that any hinge width is also included within the scope of the present invention. The receiving channel advantageously provides support and protection for sleeve bundle 14 at its most vulnerable point; the point at which sleeve extensions 8*a* are bound together as noted above. It should be appreciated that in traditional book bindings multiple pages are printed on a single sheet, folded multiple times, sewn along the common fold and the remaining folds are cut to form a page set sewn together. Multiple page sets are then glued to gauze and end pages which in turn is glued to various components of the hardcover. This arrangement allows for the hinge to be disposed contiguously along each longitudinal edge of the spine. In contrast, book pages 2 of the present invention are secured solely by sleeves 3 and therefore ample surface area for binding is crucial for their proper binding. Sleeve extension 8*a*, are bounded by fastener 9 as noted above and to prevent sleeve tearing at their point of interconnection there is particular need to provide additional support and protection. This additional support is created by the receiving channel formed by spine 5 and spine flanges 13 in which sleeve bundle 14 is cradled and glued. End pages (not shown) are glued to spine flanges 13, to hardback covers 6 and to the outer most sleeves 3 as is known by those skilled in the art. Hardback covers open and close along hinge 7 as depicted. In an exemplary, non-limiting embodiment hardcover casing 4 is constructed from 500 gram cardboard in an exemplary, non-limiting embodiment.

Following are the steps involved in binding sleeve protected pages in a hardcover casing.

Page Formation

- Separate printed content from a single sheet containing content of several pages to form a single book page.
- Insert each page 2 into a respective sleeve 3.

Binding of Sleeve Protected Pages

- Align all sleeves containing pages and glue gauze to the outer sleeves so as to cradle outer sleeves in the gauze.
- Glue end page to each outer sleeve and gauze.
- Bind sleeve extensions 8, gauze and end pages together by way of a fastener 9.

Binding the Sleeve Bundle inside the Hardcover Casing

- Stick printed covering to hardcover casing 4
- Glue casing to end page attached to sleeve bundle 14 so that each hinge 7 is noncontiguous with spine back 5

It will be appreciated that the above descriptions are intended only to serve as examples, and that many other embodiments are possible within the scope of the present invention as defined in the appended claims.

What is claimed is:

1. A book comprising:

(a) a plurality of pages, each of said plurality of pages being disconnected from each other; and (b) a plurality of protective sleeves, each of said pages being disposed in a respective sleeve of said plurality of sleeves in a non-bonded manner, each of said plurality of sleeves including a sleeve extension extending about 1.5 centimeters beyond a width that is substantially, equal to a width of a page of said plurality of pages and terminating in an opening in a back edge thereof, said plurality of sleeves bound together into a bundle by way of a fastener binding a plurality of said sleeve extensions only, such that each of said pages is non-removably held inside its said respective sleeve within said bundle.

2. The book of claim 1, wherein said sleeve is formed of a transparent, polymeric material.

3. The book of claim 1, wherein said fastener includes at least one metallic wire.

4. The book of claim 1, wherein said fastener includes a plurality of rivets.

5. The book of claim 1, wherein said fastener includes stitching.

6. The book of claim 1, wherein said fastener includes glue.

7. The book of claim 1, further comprising a hardback spine having longitudinal spine flanges forming a receiving channel in which said bundle of protective sleeves is cradled.

8. The book of claim 7, further comprising two hardback covers, each of said covers hinged to one of said spine flanges so as to enable said covers to be opened and closed.

9. A book comprising:

(a) a plurality of pages, each of said pages is non-removably enclosed in a separate protective sleeve in a non-bonded manner, said sleeves fastened together to form a bundle of protective sleeves; and (b) a hardback spine having longitudinal flanges forming a receiving channel in which said bundle of protective sleeves is cradled.

10. The book of claim 9, further comprising: two hardback covers, each of said covers hinged to one of said spine flanges so as to enable said covers to be opened and closed.

11. A method of binding a book of sleeve protected pages comprising the steps of:

(a) providing a plurality of protective sleeves, each of said plurality of protective sleeves including only one opening in a back edge thereof;

(b) inserting one book page in each of said protective sleeves; and (c) securing said pages non-removably and in a non-bonded manner within said sleeves only by using a fastener to bind said back edges of said sleeves into a bundle.

12. The method of claim 11, wherein the step of fastening said sleeves into a bundle by way of a fastener includes stapling.

13. The method of claim 11, wherein the step of fastening said sleeves into a bundle by way of a fastener includes gluing.

14. The method of claim 11, wherein the step of fastening said sleeves into a bundle by way of a fastener includes riveting.

15. The method of claim 11, wherein the step of fastening said sleeves into a bundle by way of a fastener includes sewing.

16. The method of claim 11, wherein the step of fastening said sleeves into a bundle by way of a fastener gluing.

17. The method of claim 11, further comprising a step of cradling said bundle of protective sleeves in a receiving channel formed by hardback spine having longitudinal, spine flanges.

18. The method of claim 11, further comprising a step of attaching a hardback cover to each of said spine flanges so as to enable said covers to be opened and closed.

19. The book of claim 7, wherein said longitudinal spine flanges are about 10 mm to 20 mm wide.

20. The book of claim 9, wherein said longitudinal flanges are about 10 mm to 20 mm wide.

* * * * *